US010775125B1

(12) United States Patent
Owen, Jr. et al.

(10) Patent No.: US 10,775,125 B1
(45) Date of Patent: Sep. 15, 2020

(54) GRIP TRAINING AID

(71) Applicants: Earl Bruce Owen, Jr., Show Low, AZ (US); Robert R Tupper, The Dalles, OR (US)

(72) Inventors: Earl Bruce Owen, Jr., Show Low, AZ (US); Robert R Tupper, The Dalles, OR (US)

( * ) Notice: Subject to any disclaimer, the term of this patent is extended or adjusted under 35 U.S.C. 154(b) by 0 days.

(21) Appl. No.: 16/743,670

(22) Filed: Jan. 15, 2020

Related U.S. Application Data

(60) Provisional application No. 62/899,091, filed on Sep. 11, 2019.

(51) Int. Cl.
*F41A 33/00* (2006.01)

(52) U.S. Cl.
CPC ..... *F41A 33/00* (2013.01)

(58) Field of Classification Search
CPC ..... F41A 33/00; F41A 33/06; A63B 23/00; A63B 23/16
USPC ..... 434/16, 18, 247, 258, 260; 482/44, 482/47–49
See application file for complete search history.

(56) References Cited

U.S. PATENT DOCUMENTS 1,494,407 A * 5/1924 Beach ..... F41A 33/00 42/106
1,796,216 A * 3/1931 Pettersson ..... A63B 23/16 482/47
2,205,161 A * 6/1940 Vick ..... A63B 23/16 482/49
2,634,976 A * 4/1953 Mock ..... A63B 23/16 482/48
3,216,259 A * 11/1965 Bendix, Jr. ..... A63B 23/16 73/379.03
3,653,659 A * 4/1972 Zinkin ..... A63B 23/16 482/49
4,513,962 A * 4/1985 Robson ..... A63B 23/16 482/128
4,678,181 A * 7/1987 Ditsch ..... A63B 23/16 482/128
5,147,256 A * 9/1992 Silagy ..... A63B 23/16 482/128
5,336,140 A * 8/1994 LeBlond ..... A63B 23/16 482/112
5,472,400 A * 12/1995 Royer ..... A63B 21/00047 482/141
5,611,755 A * 3/1997 Blackmore ..... A63B 23/16 482/126
6,319,175 B1 * 11/2001 Wu ..... A63B 21/023 482/126
7,438,669 B1 * 10/2008 Bloom ..... A63B 21/0004 482/1

(Continued)

*Primary Examiner* — Kurt Fernstrom

(57) ABSTRACT

An exercise and training tool is provided for training handgun users to establish a strong grip with the thumb, palm, and other fingers of the hand which are not the trigger finger, and then to independently exercise the index finger in the more delicate and precise motions used for controlling the trigger for improved accuracy. The training tool may also disable a trigger pull function by the index finger unless a proper grip is maintained with the thumb, palm, and other fingers of the hand. Other tactile feedback included within the trigger pull sensation may be offered, to represent operations of a handgun such as trigger "break," trigger reset, or recoil during a discharge.

23 Claims, 11 Drawing Sheets

(56) References Cited

U.S. PATENT DOCUMENTS

| | | | | |
|---|---|---|---|---|
| 7,470,217 | B2 * | 12/2008 | Jones-Glaser | A63B 21/0085 482/49 |
| 7,927,266 | B1 * | 4/2011 | Morris | F41A 33/00 434/16 |
| 8,684,737 | B1 * | 4/2014 | Jordan | F41A 33/00 434/16 |
| 8,926,477 | B2 * | 1/2015 | Lynn | A63B 23/16 482/127 |
| 9,474,931 | B2 * | 10/2016 | Alldredge | A63B 23/16 |

* cited by examiner

GRIP TRAINING AID

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

CROSS REFERENCE TO RELATED APPLICATION

This non-provisional utility application claims the benefit of and priority to U.S. Provisional Patent Application 62/899,091 "Grip Training Aid," filed Sep. 11, 2019. The entire contents of U.S. Provisional Patent Application 62/899,091 "Grip Training Aid," filed Sep. 11, 2019 are hereby incorporated into this document by reference.

FIELD

The invention relates to training equipment for activities where it is desired to differentiate the development of fine motor control and delicate motions of an index finger from the development of a firm and stable grip developed by the palm, thumb, and other fingers of the hand.

BACKGROUND

The vast majority of gripping motions employed in work and leisure activities coordinate the thumb, palm, and all fingers of the hand in concert, such as the use of impact tools having handles, or vehicle or machine controls having yokes. It is known but much less common that some mechanisms or vehicle controls are designed to operate with a strong grip established by most of a user's hand, while at the same time fine manipulation and control is required from the index finger of the user's hand.

Examples of these special cases include moving a control stick having a handgrip equipped with a push button or trigger incorporated therein, or shooting a firearm, where accuracy is determined in large part by the ability of the shooter to perform fine motions of the trigger finger while at the same time the thumb, palm, and other fingers of the hand must develop and maintain a more intense grip or squeeze on the grip, stock, or handle of the weapon in order to provide a stable platform during recoil of the weapon.

BRIEF DESCRIPTION

A primary objective of the invention is to provide an exercise and training tool for tasks where the index finger is involved in fine motor control or delicate or precision movements and forces while the thumb, palm, and other fingers of the hand are involved in a coarser, higher force gripping task on a handle or a grip area of a tool.

Another objective of the invention is to provide a tool more specifically adapted for training handgun users to establish a strong grip with the thumb, palm, and other fingers of the hand which are not the trigger finger, and then independently exercise the index finger in the more delicate and precise motions used for controlling the trigger for improved accuracy.

Another objective of the invention is to provide a training tool which offers feedback to the user so that an improper or ineffective grip may disable other desired functions such as a trigger pull. A corollary objective of the invention is to provide a handgun or pistol grip training aid wherein a trigger pull motion by the index finger is only available while a proper grip is maintained with the thumb, palm, and other fingers of the hand.

Yet another objective of the invention is to provide aid which supplies tactile feedback to the user when a proper grip has been established, and provides other tactile feedback within the trigger pull sensation which may represent other operations of a handgun such as trigger "break," trigger reset, or recoil during a discharge.

BRIEF DESCRIPTION OF THE DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components. In this specification a "component" may refer to a unitary object or a subassembly of objects which operate in concert.

DETAILED DESCRIPTION OF CERTAIN EMBODIMENTS

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this application the use of the singular includes the plural unless specifically stated otherwise, and use of the terms "and" and "or" is equivalent to "and/or," also referred to as "non-exclusive or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

When used to modify words such as "equal," or "equivalent to," "parallel," or "perpendicular" the word "substantially" in this specification means within 10° of a theoretical absolute for angular comparative words, and within 15% of a theoretical absolute for linear dimensions or scalar quantities.

The invention relates to a grip training aid which is an exercise and training tool provided for training handgun users to establish a strong grip with the thumb, palm, and other fingers of the hand which are not the trigger finger, and then to independently exercise the index finger in the more delicate and precise motions used for controlling the trigger for improved accuracy.

According to an alternate embodiment within the scope of the invention, the grip training aid may also disable a trigger pull function by the index finger unless a proper grip is maintained with the thumb, palm, and other fingers of the hand. Other tactile feedback included within the trigger pull sensation may be offered, to represent operations of a handgun such as trigger "break," trigger reset, or recoil during a discharge.

Figure 1A:
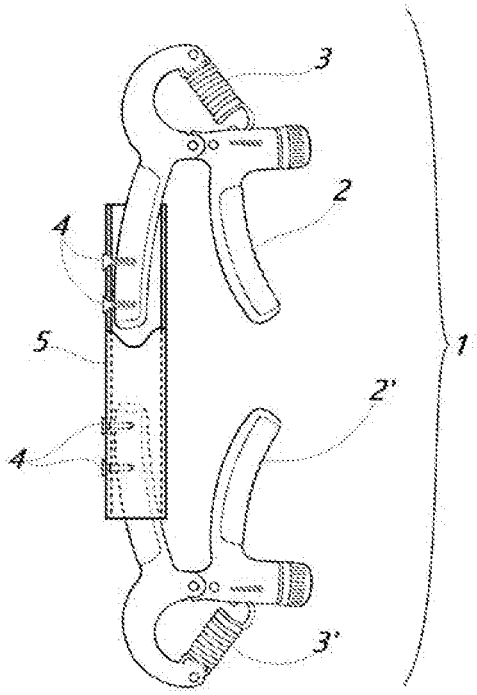
FIG. 1*a* shows an embodiment of a grip training aid in accordance with the invention.

FIG. 1*a* shows an embodiment of a grip training aid [1] in accordance with the invention. The device has a frame for grasping at a grip site for a user's hand, which in this embodiment includes a handle which is a tube [5.] A first rotatable lever [2] and a first elastic component [3] are connected between the frame and the first rotatable lever. In this embodiment the connection point of the elastic component onto the rotatable lever is adjustable so that the distance from this connection point to the fulcrum or rotational center of the rotatable lever may be varied so the resistance force experienced when the user pulls the lever by adducting a finger of the hand may also be varied. The first rotatable lever is positioned with respect to the frame so that it is prehensible by the index finger the hand while that hand is grasping the training aid at its grip site.

In this specification an elastic component is an extensible or compressible component whose deformation produces a restoring force related to its excursion from its natural or undeformed length. A rod of an elastic material such as rubber or foam rubber, or a spring such as a helical spring, or an elastic band fixed between two points may all be used as an "elastic component" in this specification. An elastic component may be a single unitary member or it may further comprise two or more elastic elements connected in series or in parallel so that in concert the set of elastic elements within act as a single elastic component. The relationship between deflection and force of an elastic component may be linear or non-linear and may also include a first deflection region where the relationship is positive and a second deflection region where the relationship is negative. A detent feel may be created by having a sharp transition between positive and negative spring rates over a very short region of the entire range of excursion of the elastic component.

A second rotatable lever [2'] having a second elastic component [3'] connected between it and the frame is positioned so that while the user grips the frame at the grip site, and is able to reach and operate the first rotatable lever using the index finger, the second rotatable lever is prehensible or within reach of the other fingers of the hand, such as by at least any one of a second finger, a third finger or a fourth finger.

Adjustment of the location of the rotatable levers with respect to the grip tube and its grip site may be accomplished by choice of placement or adjustment of mounting screws [4] which anchor a pair of hand grip exercise tools which provide the rotatable levers of the invention. The screws fix the non-rotating handles of the exercise grips so that they become integral to the frame of the invention and so that the frame in this embodiment comprises the tube plus the non-rotating portions of the exercise grips affixed to the tube.

Also the connection site of the first elastic component to the first rotatable lever is adjustable and the connection site of the second elastic component to the second rotatable lever is also adjustable. These adjustments allow the user to select preferred ranges of resistance forces felt in the trigger finger (or index finger) and in the other three fingers of a gripping hand, and especially to tune the resistance forces to mimic those of a particular make or model of a handgun.

Figure 1B:
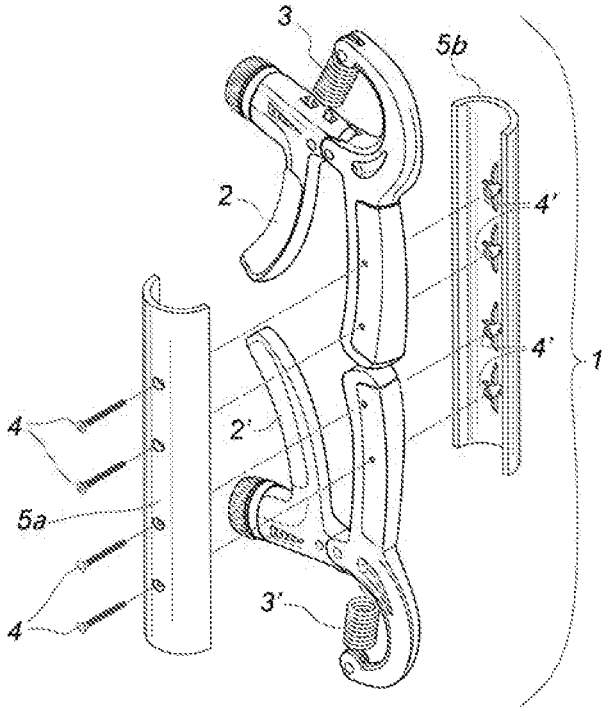
FIG. 1*b* shows an alternate view of the embodiment of a grip training aid similar to that shown in FIG. 1*a* but having a split or two-part handle shown exploded.

FIG. 1*b* shows an alternate view of an embodiment of a grip training aid [1] similar to that shown in FIG. 1*a* but having a split or two-part handle shown exploded. The screws [4] which hold the split halves of the frame together pass through the first half-frame [5*a*] to seat into bosses [4'] in the second half-frame [5*b*.] A first rotatable lever [2] and a first elastic component [3] are connected between the frame and the first rotatable lever, and a second rotatable lever [2'] and a second elastic component [3'] are connected between the frame and the first rotatable lever. The frame in this embodiment is the conjoined sum of its half-frames.

Figure 1C:
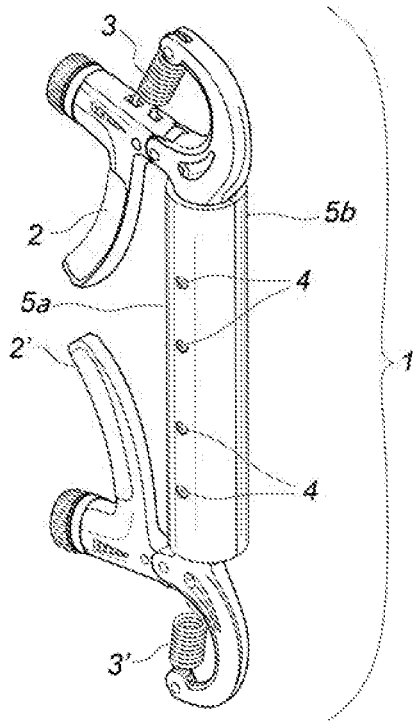
FIG. 1*c* shows an alternate view of an embodiment of the grip training aid of FIG. 1*b*.

FIG. 1*c* shows an alternate view of the embodiment of the grip training aid [1] of FIG. 1*b*, but with the split halves [5*a*, 5*b*] of the frame drawn together by the screws [4.] As in the previous figure, a first rotatable lever [2] and a first elastic component [3] are connected between the frame and the first rotatable lever, and a second rotatable lever [2'] and a second elastic component [3'] are connected between the frame and the first rotatable lever.

Most commonly the user will use all three fingers which are not the index finger to grasp the grip site and operate the second rotatable lever in concert. In practice, the spring force of the first elastic component as felt through the first rotatable lever may be adjusted to be much lower than the spring force of the second elastic component as felt through the second rotatable lever. This variation replicates or simulates the challenge common in handgun shooting which is that the lower fingers must grip at high intensity to provide a stable platform for accuracy and for proper function of the handgun components. For example, during a discharge of a semi-automatic pistol, besides the recoil of the bullet travelling through the barrel, other large reaction forces occur when the slide reaches the end of its excursion on the frame. All of these large forces must be absorbed by the gripping hand.

Meanwhile, the tasks of the index finger are delicate and precise in comparison. Depending on the shooting task, the user may need to practice registering the trigger finger onto the trigger without producing a slap or finger impact which degrades accuracy, or the user may need to practice releasing the trigger after a discharge so that it is released only as much as is necessary to reset the sear of a semi-automatic weapon. Resetting the trigger sear without the trigger finger coming off the trigger is a desirable skill for competition or defense shooting whenever it is desired to place multiple shots onto the same target area in a minimum amount of time.

Figure 2:
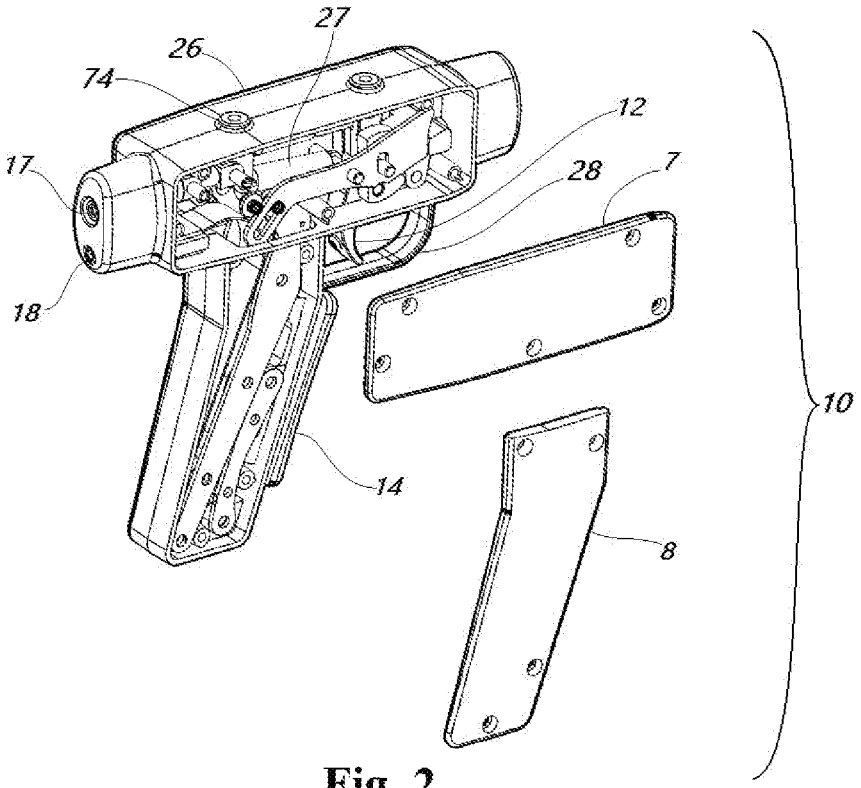
FIG. 2 shows an alternative embodiment of a grip training aid in accordance with the invention, with side plates removed to expose some internal components.

FIG. 2 shows an alternative embodiment of a grip training aid [10] in accordance with the invention, with side plates removed to expose some internal components. This embodiment includes a frame [26] more reminiscent of a handgun or hand held weapon, and sets of internal components which cooperate so that the trigger pull motion simulated by its first rotatable lever [12] is blocked unless the grip portion of the pistol shape is grasped strongly enough. Some firearms incorporate a similar mechanism referred to as a "grip safety," in which the grip site of the weapon includes one or more retractable strips which remain extended unless an acceptably strong hand grip at that site gathers and compresses the retractable strips. The firing mechanism is disabled unless a grip condition is established whereby the retracted strips clear a blocking element obstructing the firing pin or immobilizing or disconnecting the trigger from the rest of the fire control components within the weapon. The frame also includes one or preferably two, or more than two bosses [74] having threaded holes for mounting a Picatinny rail, a tactical flashlight, or other related accessories.

In this embodiment, the first rotatable lever is shaped like a handgun trigger and resides within a trigger guard portion [28] of the frame. The first rotatable lever as claimed will be referred to as a "trigger" and the second rotatable lever will be referred to as a "pivot lever" in the description of the embodiment shown in this figure and its similar variants within the scope of the invention as described further. A grip safety strip [14] resides at the grip site below the trigger guard and is available for one or more of the fingers of the gripping hand which are not the trigger finger to grasp so as to retract the strip inward into the grip portion of the frame. The grip safety strip may be made of a single material or may incorporate a rigid portion and an elastomeric pad affixed to the rigid portion by mechanical interference, by an adhesive, or by being overmolded onto the rigid portion.

Side plates [7, 8] are shown exploded from the frame to reveal some of the internal components, including one of the elastic elements [27] comprising the elastic component operating between the trigger and the frame. The elastic components may be adjusted within a range of preload tension or compression by means of screws. Trigger preload may be adjusted using cap screw [17,] and the preload of the second elastic component connected to the pivot lever may be adjusted using set screw [18.]

Figure 3:
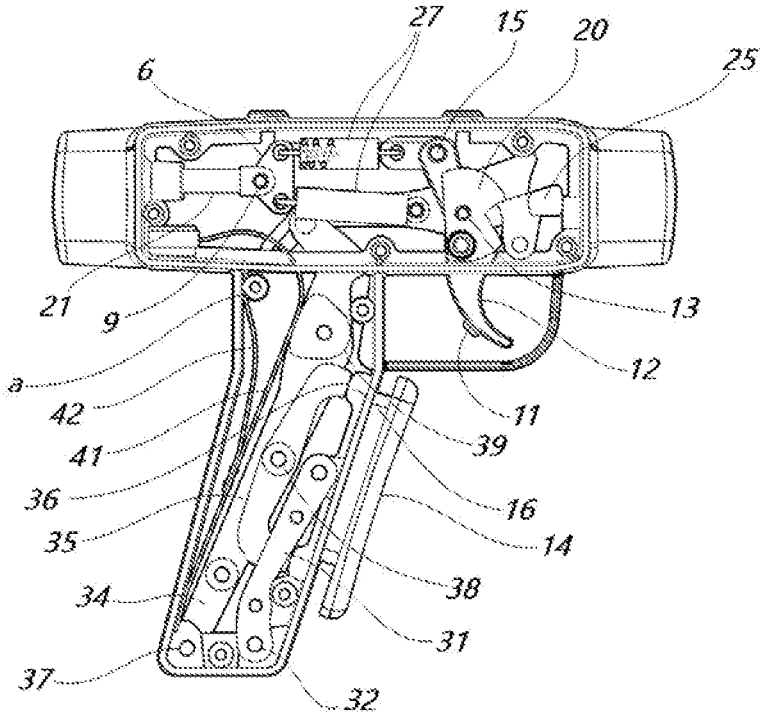
FIG. 3 shows the alternative embodiment of FIG. 2 identifying other internal components.

FIG. 3 shows the alternative embodiment of FIG. 2. identifying other internal components. The grip safety strip [14] is slideable between an extended and a retracted position in the grip body portion of the frame, and operates a pivot lever [34] which is the second rotatable lever of the invention. The pivot point or center of rotation of the pivot lever is the pin, screw, or dowel shown at [37.] To prevent the grip safety strip from binding during its travel into and out of the grip section of the frame, its motion is modulated by a third rotatable lever called a grip trigger pivot arm [31.] The pivot point or center of rotation of the grip trigger pivot arm is the pin, screw, or dowel shown at [32.] The pivot lever accepts gripping force from the grip safety strip through a rocker plate [35] which is pivotably attached to the pivot lever at the center of rotation [37] of the rocker plate. The attachment of the rocker plate to the pivot lever may alternatively include friction-reducing means such as a bushing or a washer made of a bearing material comprising brass, bronze, oil impregnated bronze, Teflon® or another polytetrafluoro-ethylene, steel, stainless steel, 400-series stainless steel, 420C stainless steel, Delrin® or another acetal or a polyoxymethylene, a polybutylene terephthalate, or compounds containing blends or alloys of one or more of these materials.

The mechanical interface between the grip safety strip and the rocker plate comprises two contact pads [16] on the grip safety strip which touch two contact pads [36] on the rocker plate. Two of each of these pads are present but only one of each is visible in this figure.

The second elastic component in this embodiment is an assembly of two leaf spring members. The main leaf spring [41] extends from one end held in a mount block in the upper portion of the handgun-shaped frame. A portion of the leaf spring passes substantially parallel to the pivot lever, and the other end is anchored in a crotch in the distal part of the grip portion of the frame near the center of rotation of the pivot lever. One end of a helper leaf spring [42] is affixed to a medial attachment point on the main leaf spring, and the other end of the helper leaf spring is anchored in another crotch [a] in the grip portion of the frame near where this grip portion meets the upper portion of the frame.

A pivot lever cam [39] is mounted on the pivot lever so that it impinges upon the second elastic component. The resilient structure of the two conjoined leaf springs provides an adjustable resistance in the grip safety strip which must be overcome so that the grip safety strip may be compressed into its retracted position within the frame.

The first rotatable lever in this embodiment is a trigger [12] pivotable about a screw, pin, or dowel at [13.] The trigger includes an adjustable screw [11] which may be used to limit the travel of the trigger. At least one trigger travel anchor [20] is pivotable about the same pivot point as the trigger, and is coupled to the trigger for coaxial rotation therewith, and includes a cutout which receives a stop pawl [25] while the grip safety strip is free to rest in its extended position. With the stop pawl received into the trigger travel anchor cutout as shown, rotation of the trigger is prevented, transmitting negative reinforcement to a user attempting to pull the trigger without first establishing a proper grip at the grip site of the training aid. A proper grip will fully retract the grip safety strip, and through the mechanism to be explained in further detail below the proper grip will push the stop pawl clear of the trigger travel anchor, allowing it to rotate and allowing the trigger to be pulled to the satisfaction of the user.

With the trigger as the first rotatable lever in this embodiment, the end of the lever on the other side of the pivot point from the end which receives an index finger includes a clevis and pin [15] for connecting to the first elastic component. In this embodiment the elastic component comprises two tensile elastic elements [27] coupled in series through a bellcrank [6.] The tensile elastic components may be rods or beams of elastic materials or in a preferred embodiment they are helical springs. Preload in the first elastic component is adjustable by means of moving the fulcrum of the bellcrank away from the trigger clevis, stretching the elastic elements of the elastic component and raising the force stored therein which is to be overcome by the finger pulling the trigger. This preload tension adjustment is effected by turning an adjustment cap screw [17 in FIG. 2] which resides within an internally threaded clevis [21] pinned to the fulcrum of the bellcrank using a pin, a threaded rod, or dowel [9.]

Figure 4A:
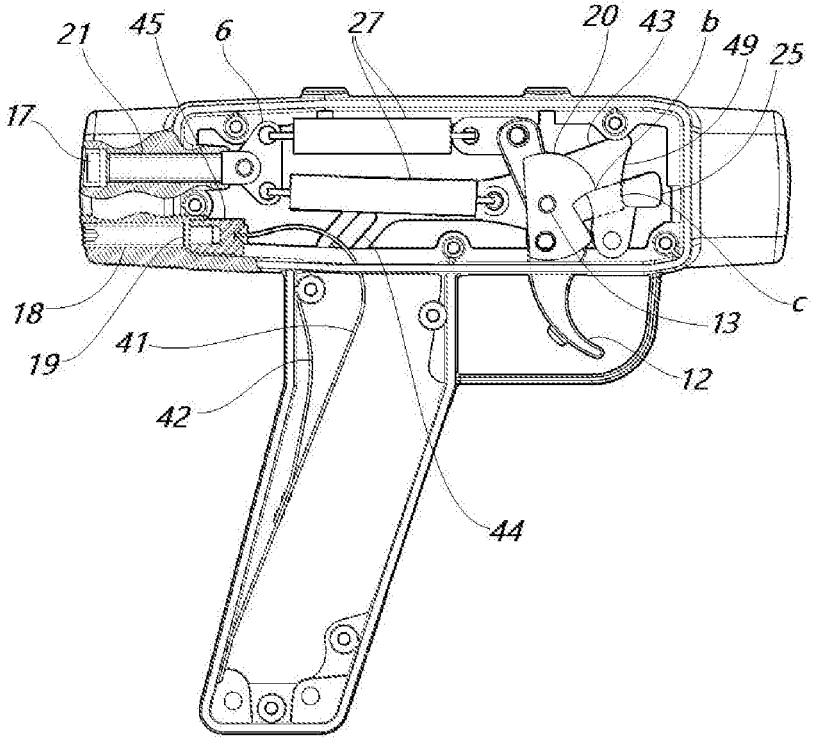
FIG. 4*a* shows the alternative embodiment of FIG. 2 with some internal components removed to reveal other internal components for further discussion.

FIG. 4*a* shows the alternative embodiment of FIG. 2, with some internal components removed to reveal other internal components for further discussion. In this figure a section of frame is shown broken out to reveal a preload tension adjustment for the first elastic component, which is shown set at a high level in that the adjustment cap screw [17] has pulled the internally threaded clevis [21] which pulls the bellcrank [6] so that the two elastic elements [27] of the first elastic component are extended.

The trigger [12] is blocked from being pulled by the user because a portion of the stop pawl [25] remains received within a cutout of the trigger travel anchor [20] at point [b.] The trigger and at least one trigger travel anchor are attached to each other for coupled rotation about a screw, pin, or dowel at [13.] A pivotable trigger cam lever [43] includes an arcuate edge [49] which contacts a boss of the stop pawl at [c.] When pivoted clockwise in this figure, the arcuate edge pushes the boss to move the pawl clear of the cutout in the trigger travel anchor. Although in this embodiment the pawl rotates clear of the trigger travel anchor, it is also contemplated within the scope of the invention that a slidable pawl may be translated into and out of a blocking location whereby it denies a trigger pull motion of the first rotatable lever of the invention. The trigger cam lever includes an angled slot [44] on an end opposite the end with its arcuate edge.

Another portion of the frame is shown as a broken out section to reveal a set screw [18] adjustment for the mount block [45] which receives one end of the strip material which is the main leaf spring [41] member of the second elastic component of the invention. Rotating the threaded set screw moves a thrust washer [19] to which the mount block is coupled for translation therewith.

Figure 4B:
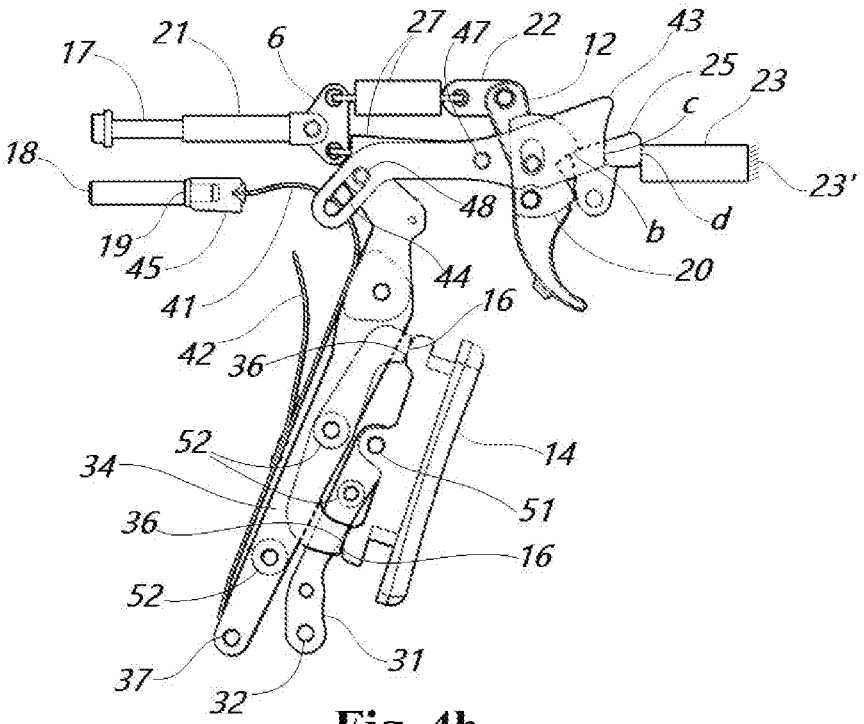
FIG. 4*b* shows a set of components within the alternative embodiment of FIG. 2 which cooperate so that while a preferred grip on the training aid is not established, a trigger pull motion is prevented.

FIG. 4*b* shows a set of components within the alternative embodiment of FIG. 2 which cooperate so that while a preferred grip on the training aid is not established, a trigger pull motion is prevented. With the first rotatable lever, which is the trigger [12,] and the grip safety strip [14] both released, the grip safety strip resides in an extended position. The first elastic component is a subassembly which comprises two tensile elastic elements [27] connected in series through a bellcrank [6.] The preload or initial stretch of the elastic elements may be adjusted by means of the threaded cap screw [17] translating the internally threaded clevis [21] to change the extension lengths of the two tensile elastic elements. The first rotatable lever is connected to the first elastic component by means of a link [22] and pins, screws, or dowels.

The second rotatable lever [34] of the invention is a pivot lever which rotates about a pin, screw, or dowel shown at [37] and attached to the frame or a side plate attached to the frame. This rotation is opposed by a second elastic component which in this embodiment is built up of two leaf springs, a main leaf spring [41] and a helper leaf spring [42.] The preload or resilience of the second elastic component may be adjusted by moving the end of the main leaf spring where it is received into mount block [45.] This adjustment is made by turning a threaded set screw [18] to translate a thrust washer [19] along its length, with the thrust washer coupled to the mount block. Guide features within the frame or the frame side plates, such as rails and grooves or rabbets and dadoes, constrain the mount block to linear translation only and prevent it from tipping or otherwise binding while it is being slideably adjusted.

A pivot lever cam is mounted on the pivot lever so that it impinges upon the second elastic component when the pivot lever is rotated (counterclockwise in this figure) by a gripping hand moving the grip safety strip into its retracted position. The grip safety strip includes two contact pads [16] which touch two contact pads [36] on the rocker plate. The motion of the grip safety strip is guided against binding by means of a grip trigger pivot arm [31.] The pivot point or center of rotation of the grip trigger pivot arm is the pin, screw, or dowel shown at [32.] The grip safety strip connects to the grip trigger pivot arm with a pin, screw, or dowel shown at [51.]

Friction within the mechanism may be reduced by including bushings [52] at points of rotation of these and other components. Bushings may preferably include bearing materials such as brass, bronze, oil impregnated bronze, Teflon® or another polytetrafluoro-ethylene, steel, stainless steel, 400-series stainless steel, 420C stainless steel, Delrin® or another acetal or a polyoxymethylene, a polybutylene terephthalate, or compounds containing blends or alloys of one or more of these materials.

With the trigger released, it resides in a fully extended position under the preload spring force of the first elastic component. In this position at least one trigger travel anchor [20,] coupled to the trigger for coaxial rotation therewith, is oriented so that a cutout in the trigger travel anchor admits a portion of a stop pawl [25] so that rotation of the trigger is denied in this condition. A compressible elastic component [23] operates between a portion of the frame [23'] and a contact point on the stop pawl at [d] so that when the cutout in the trigger travel anchor is aligned with the stop pawl, the compressible elastic component extends to push the stop pawl into the cutout to block rotation of the travel anchor.

To allow a trigger pull movement, a pivotable trigger cam lever [43] operates between the first and second rotatable levers. The cam lever includes an arcuate edge which contacts a boss of the stop pawl at [c.] When pivoted clockwise in this figure, the arcuate edge pushes the boss to move the stop pawl clear of the cutout in the trigger travel anchor. The trigger cam lever includes an angled slot [44] on an end opposite the end with its arcuate edge. A pin [48] attached to the pivot lever, which is the second rotatable lever in this invention, rides within the angled slot so that when the pivot lever rotates about its center of rotation the pin in the slot forces the trigger cam lever to pivot clockwise as seen in this figure, about a center of rotation defined by the pin, screw, or dowel shown at [47] which is attached to the frame or to a side plate attached to the frame. However, if the grip safety strip is moved partially but not completely into its retracted position within the frame, a portion of the stop pawl may remain within the cutout of the trigger travel anchor so that these parts continue to touch at [b] of this figure and the trigger remains blocked from rotation.

Figure 4C:
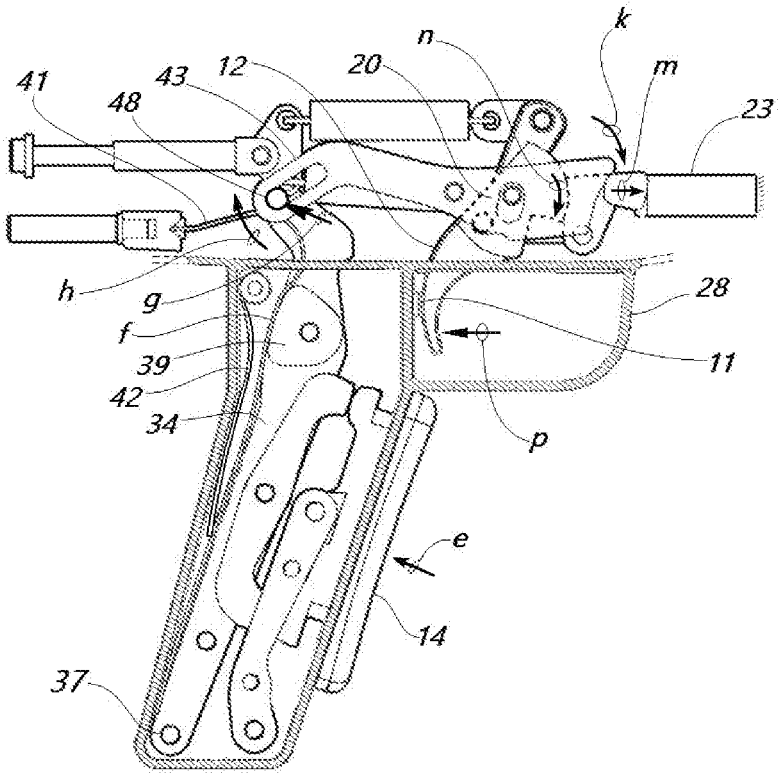
FIG. 4*c* shows the set of components of FIG. 4*b*, but with components in positions in accordance with a preferred grip, so that in a configuration shown in this figure, a trigger pull motion is available.

FIG. 4*c* shows the set of components of FIG. 4*b*, but with components in positions in accordance with a preferred grip, so that in a configuration shown in this figure, a trigger pull motion is available. The sequence by which a proper grip as detected by the grip safety strip allows a trigger pull motion proceeds as follows: First, fingers of the user's gripping hand wrap around the grip safety strip [14] and push it inward into the grip portion of the frame along a direction indicated by arrow [e.] The grip safety strip is pinned to the grip trigger pivot arm to prevent binding during its travel. The rocker plate rotates so that its two contact pads pick up and re-unify the user's grip forces as bifurcated between the two contact pads of the grip safety strip, and the rocker plate also averages the inward deflection of the two pads of the grip safety strip.

An important aspect of the training aid is that novice users may commit an unequally large share of gripping force to the second finger of the hand while neglecting to adequately commit the third and fourth fingers of the hand to share the gripping task appropriately and efficiently. In such a sub-optimal grip attempt, only the upper part of the grip safety strip will fully enter into a retracted position within the frame. While a user's grip remains deficient in the third and fourth fingers, rotation of the rocker plate as it contacts the fully retracted pad and the inadequately retracted pad of the grip safety strip reduces the deflection of the pivot lever to about half of what its deflection would be for a proper grip wherein the three lower fingers are all exerting adequate force and fully retracting the entire length of the grip safety strip into the frame. Thus, a grip relying primarily on the third finger alone will be discouraged by this grip training aid in that such a condition is insufficient to release the stop pawl, and the user remains unable to pull the trigger.

The grip force is transferred into second rotatable lever of the invention which in this embodiment is also called a pivot lever [34.] The grip force is transferred to the pivot lever at a point closer to the fulcrum or rotation point [37] of the lever than the reaction force acting in the pin [48] which attaches the pivot lever to the trigger cam lever [43.] Thus the pivot lever operates as a third order lever. While the pin rides in the slot of the trigger cam lever, a pivot lever cam [39] mounted on the pivot lever moves to impinge at a point [f] upon the main leaf spring [41] of the second elastic component, providing a resistance to be overcome at the grip safety strip and felt by the user's gripping hand. The pivot lever cam contacts the main leaf spring partway into the excursion of gripping motion to that the spring rate increases thereafter as a proper grip is completed.

Although the main leaf spring of the second elastic component may bow so as to produce a linear, positive, proportional, or direct relationship between the applied grip force transmitted to it and its deflection, the helper spring may be designed so that with its point of contact, its length, and whether or not bending moment is allowed at its attachment point to the frame, it accumulates stress from deflection until its attachment point to the main spring becomes eccentric or offset enough from its local longitudinal axis so that the helper spring buckles when compressed by contact with the second rotatable lever. In this figure the helper spring [42] is shown buckled away from the main leaf spring, with the buckled section further constrained by contact with an interior portion of the frame. The transition from a stressed arch to a buckled shape may be abrupt so as to cause a distinct detent feel in the grip safety strip. The impact of the buckled strip may also create a palpable impulse felt within the grip by other regions of the user's griping hand such as the palm or the web between the thumb and index finger. The impact of the buckled strip may also create an audible signal useful for training a user to appreciate when a proper grip has been established.

Either or both leaf springs may vary in width along their lengths so as to provide a desirable reaction force over the excursion of the grip safety strip from its extended position at rest to its retracted position in the frame. A tactile detent may also be created by allowing a laterally extending lug or nose on either leaf spring to encounter a ridge or a pocket in the frame or a sidewall attached to the frame, so that a sharp local variation occurs in the relationship between grip safety strip compression and resistance force felt in the grip. Such a spring force variation or the event of a portion of a spring tripping over an obstacle feature in the frame or a side plate may also be designed to emit a noise useful for training a user when a proper grip has been established.

Other detent mechanisms are also contemplated within the scope of the invention, such as an aperture or dimple in pivot lever that passes by a ball detent so as to create a user-detectable 'click' which may also include an audible component. If proper grip is lost, the pivot lever moves through the detent again and alerts the user that the grip has moved out of an acceptable configuration. Alternative embodiments for the position of the detent include a dimple or aperture or a coined feature on another pivoting component such as the trigger, the trigger travel anchor, or the trigger cam lever, or the stop pawl. Another alternative method for creating a detent sense is to incorporate a tongue in the middle or lower portion of the second elastic component with this tongue residing within the grip portion of the frame, so that when the spring is deformed enough a non-linear collapse of spring rate near or through zero and then back up to close to an immediately previous value of spring rate occurs. This 'oil can' detent effect may also be engineered to create an audible, metallic click or ping noise, and because of its location in the lower portion of the grip, the user will feel the detent readily.

With the grip safety strip fully retracted, the pin on the pivot lever moves in a direction indicated by arrow [g] and the trigger cam lever pivots clockwise as shown by the pivoting arrows [h] and [k.] The arcuate edge of the trigger cam lever forces a boss on the stop pawl to move away from the trigger travel anchor [20] in a direction shown by arrow [m,] and the pawl also compresses the compressible elastic component [23.] With the stop pawl moved completely out of the cutout in the trigger travel anchor, the trigger [12] and trigger travel anchor are free to rotate in the direction indicated by arrow [n,] which also allows the trigger to be pulled in a trigger pulling motion shown by arrow [p.] Lastly in this figure, a trigger guard portion [28] of the frame and the grip portion of the frame are also shown here in cross section to illustrate the relationship between the trigger and these portions of the frame. The adjustable screw [11] in the trigger may be set to provide a stop so that the trigger may be adjusted to mimic the feel of a particular make or model of handgun for which the user is using the training aid to develop or maintain muscle memory cues specific to that weapon.

Figure 5:
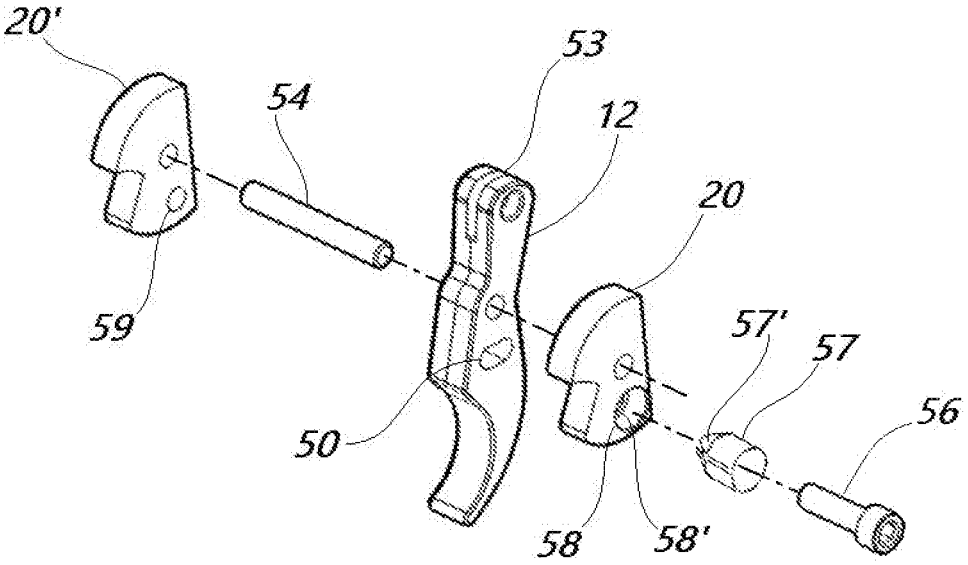
FIG. 5 shows a set of components within the alternative embodiment of FIG. 2 which include the trigger and adjustable trigger travel anchors.

FIG. 5 shows a set of components within the alternative embodiment of FIG. 2 which include the trigger and adjustable trigger travel anchors. This figure also shows the clevis feature [53] in the trigger. More than one trigger travel anchor may be rotatably coupled to the trigger [12.] The trigger includes an aperture [50] with the trigger travel anchors attached for coupled rotation by a fastener passing through the aperture, which may be a threaded fastener or a press-fit pin or a roll pin. Alternatively as shown in this embodiment, the trigger and its trigger travel anchors may ride on a pin [54] for coaxial rotation. The trigger may also be press-fit onto the pin. The pin is held rotatably within the frame, such as by bearings or bushings at the ends of the pin. A cap screw [56] which is inserted into a counterbored aperture [58] in a first trigger travel anchor [20] also passes through an arcuate slot in the trigger and is threadably received into a complementary treaded hole [59] in a second trigger travel anchor [20'] so that both trigger travel anchors may together rotate separately from the trigger in a narrow angular range. Conversely, when the trigger travel anchors are locked from rotation by the stop pawl, the trigger in this embodiment is not fully immobilized but may travel within a very narrow arc limited by the extent of the arcuate slot. This provides another more intense negative reinforcement because apparent freedom of rotation is offered and then forcibly denied once the cap screw reaches either end of the arcuate slot. Giving a tiny sample of something desirable and then taking it away may be a more cogent negative reinforcer than denying the desired action completely at first.

However, optional additional components may be included to form an embodiment wherein both or all trigger travel anchors and the trigger are mutually affixed for coupled rotation. One solution to effect this embodiment comprises the counterbored hole [58] further comprising a countersink or conical surface at the endface [58'] of the counterbore, and further including a bushing [57] closely fitted between the head diameter of the cap screw and the inner diameter of the counterbore. The bushing further comprises a conical end [57'] substantially complementary to the conical endface of the counterbore and also preferably includes a split in its perimeter so that it may compliantly contract as its conical end is drawn into the funnel shape of the conical endface of the counterbore. Conversely, the conical endface in the counterbore may be fashioned as a positive cone of material with the bushing having a complementary countersink in its end facing the cone. In this embodiment when the cap screw is tightened the bushing expands to lock against the inner diameter of the counterbore. In either of these embodiments, tightening the cap screw until it interferes with the bushing binds the trigger travel locks to the trigger so that they always rotate in concert and so that the cap screw resists coming loose in service, especially if the training aid is dropped or experiences other mechanical shocks or vibration.

Figure 6:
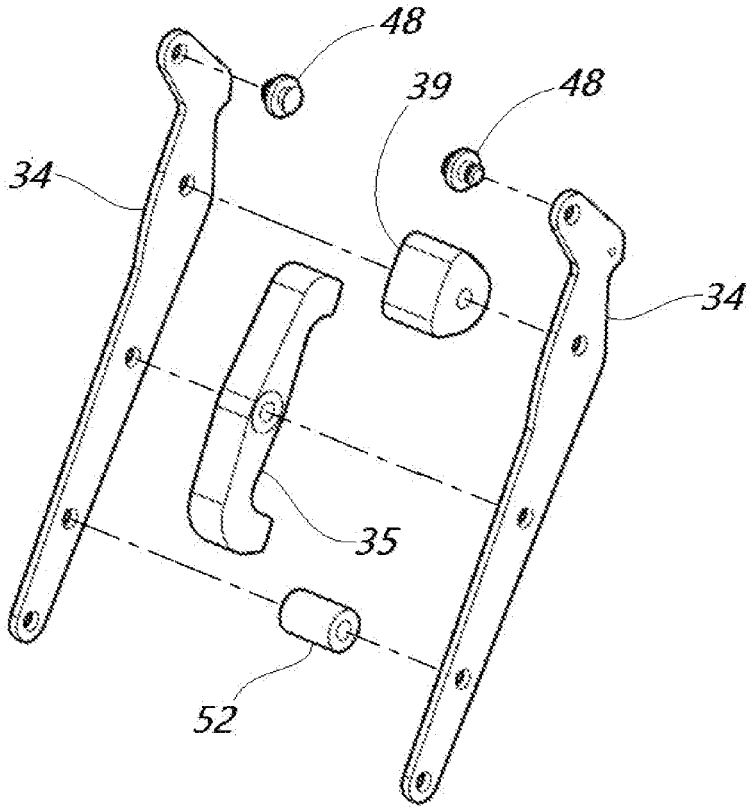
FIG. 6 shows a set of components within the alternative embodiment of FIG. 2 which include components of a pivot lever assembly.

FIG. 6 shows a set of components within the alternative embodiment of FIG. 2 which include components of a pivot lever assembly. In this embodiment the pivot lever cam [39] and a spacer [52] or bushing are sandwiched between two pivot levers [34] which are coupled together for rotation in concert as the second rotatable lever of the invention. The rocker plate [35] is pinned between the two pivot levers and may rotate about its pin (not shown.) Also not shown but within the scope of the invention is that the two pivot levers each have a pin [48] which rides in a slot of each of two pivotable trigger cam levers. In this embodiment the stop pawl includes two bosses for the arcuate edges of the two trigger cam levers to operate; when acting in concert they push the pawl clear of cutouts in the two trigger travel anchors shown in FIG. 5.

Additional embodiments and variations exist within the scope of the invention, For example, a laser may be incorporated in the frame so that when a user correctly grasps the grip the grip safety strip closes a switch and turns the laser on, so the grip training aid may also be used to develop "point and shoot" skills whereby accurate proprioception of a gripping hand aligns the longitudinal axis of the upper portion of the frame with a preferred targeting axis as evinced by the laser. This skill enables reasonably accurate shooting even without the shooter taking the time to align sighting features of a handgun.

The switch for the laser may be a common momentary contact switch, or a reed switch, a magnetic switch, or a Hall effect sensor whereby a magnet or a magnetized material brought into proximity of the switch produces a detectable change in the local magnetic field. Furthermore, data may be transmitted by a second beam or by a pulse code modulating the first laser beam which may be demodulated by a game controller or console or a camera connected to the console, in a gaming system, or in a shooting simulator system so that points may be awarded for proper grip and trigger discipline. Also, improper grip or loss of proper grip during a scenario may be detected so that diagnostic or corrective coaching messages or critiques may be displayed within the scenario or audibly transmitted to the user. Internal analytics of the user's trigger pull dynamics may also transmitted and used in a gaming environment as a program input for the game or simulator software to determine the virtual effects on targets within the game or scenario, such as improved or degraded accuracy or impact effects.

Figure 7A:
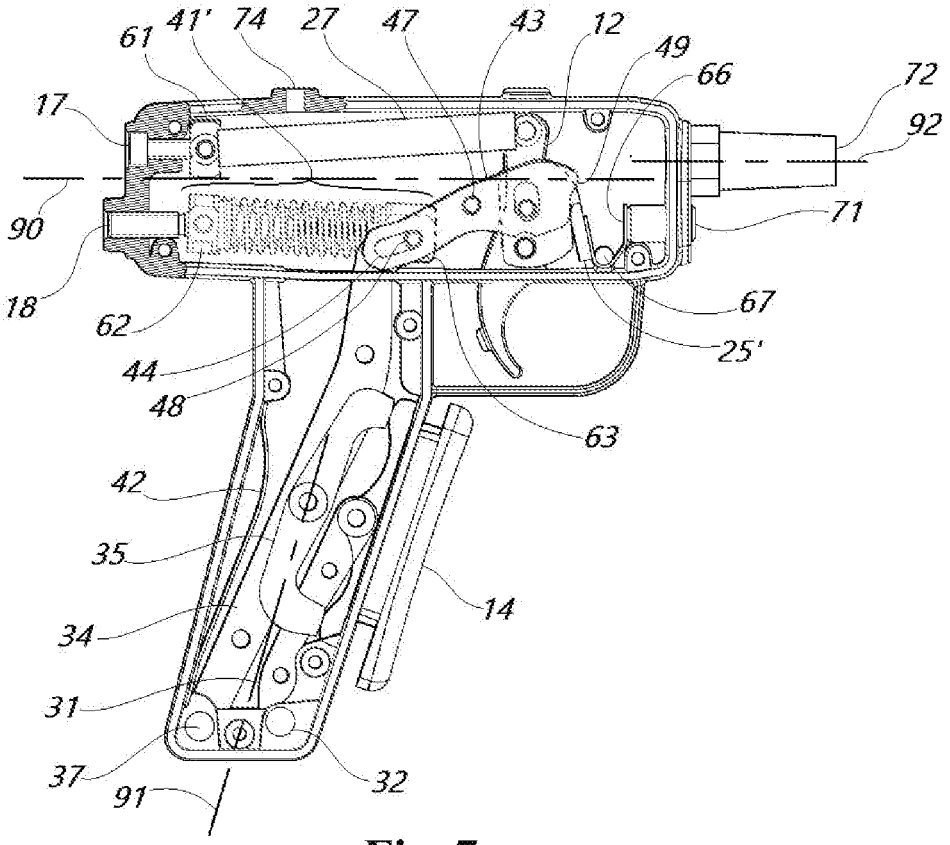
FIG. 7*a* shows an alternative embodiment within the scope of the invention wherein elastic elements of an elastic component comprise coaxial helical springs.

FIG. 7*a* shows an alternative embodiment within the scope of the invention wherein elastic elements of an elastic component comprise coaxial helical springs. The frame comprises a first portion having a first membrane defining a generally longitudinal volume and defining a longitudinal axis [90] to which a second grip body portion is attached, with the grip body portion also having a second membrane with a portion of the second membrane defining a grip body axis [91] within 35° of perpendicular to the longitudinal axis of the longitudinal volume. A replica gun barrel component [72] defines a gun barrel axis [92] which is also a shooting axis of the device when used as an aiming aid or a gaming system component.

As seen in previous figure and the embodiment shown in this figure, the grip safety strip [14] is connected to a third rotatable lever called a grip trigger pivot arm [31,] and operates a pivot lever [34] which is the second rotatable lever of the invention. The pivot point or center of rotation of the grip trigger pivot arm is the pin, screw, or dowel shown at [32.] The pivot lever accepts gripping force from the grip safety strip through a rocker plate [35] which is pivotably attached to the pivot lever at the center of rotation of the rocker plate so that the rocker plate may rotate to align its contact pads to the complementary contact pads of the grip safety strip. The pivot point or center of rotation of the pivot lever is the pin, screw, or dowel shown at [37.]

The first rotatable lever of this embodiment of the invention is the trigger [12] and it is connected to a first extendable elastic component [27] which may be a tensile material such as natural rubber, caoutchouc, or synthetic elastomers such as ethylene propylene diene monomer (EPDM) rubber or thermoplastic rubber (TPR,) or may also be a helical coil spring or other extension spring drawn into tension by rotation of the trigger. The initial tension stored in the first extendable elastic component may be adjusted so that the resistance force felt at the trigger finger may also be adjusted, especially so that the trigger pull mimics a particular make or model of handgun. This adjustment is made by rotating cap screw [17] which extends or retracts a trigger spring anchor [61] to which the end of the first elastic component is attached. The magnitude of the resistance force felt in the grip safety strip may be adjusted using the set screw [18] to adjust the preload compression of the second elastic component [41'] which in this embodiment further comprises two concentric helical compression springs. The second elastic component threadably connects to the cap screw through a first grip trigger spring anchor [62.] Rotating the cap screw translates the grip trigger spring anchor along its threaded body and changes the preload compression stored in the second elastic component.

A pivotable trigger cam lever [43] pivots about a center of rotation defined by the pin, screw, or dowel shown at [47] and attached to the frame or to a side plate attached to the frame. The trigger cam lever pivots when a pin [48] mounted to the pivot lever travels in an angled slot [44] of the trigger cam lever. This pin also passes through the second grip trigger spring anchor [63] so that over the course of excursion of the pivot lever, the grip trigger spring anchor may align itself with the axis of compression of the second elastic component. According to another embodiment within the scope of the invention, the pin or a roll pin may be attached to the pivot lever so that it passes through a transverse hole in the second grip trigger spring anchor and also passes through the angled slot in the trigger cam lever.

The trigger cam lever has an arcuate edge [49] which contacts a stop pawl [25'] mounted on a trigger lock spring [66.] The trigger lock spring is a formed strip of compliant material such as spring steel strip, a stainless steel strip, or mill-hardened rolled phosphor bronze strip. The spring strip is rotatable and hingeably compressible about a fulcrum pin [67] so that when the trigger cam lever pivots clockwise in this view, its arcuate edge dislodges the stop pawl from cutouts in the trigger travel anchors, allowing the trigger, which is the first rotatable lever of the invention, to rotate. Preload force may be stored in the spring by adjusting the stop tensioner set screw [71] so that when the cutouts of trigger travel anchors align with the stop pawl, the stop pawl snaps into the cutout decisively. The snap-in motion of the stop pawl and its collision with the one or more trigger travel anchors may be designed to make a distinctive noise and a tactile detent feel similar to the feel of a trigger sear reset discernable in most autoloading handguns.

Lastly in this figure, the grip portion of the frame includes a spring strip as a helper spring [42] which the pivot lever contacts near the end of its excursion range when the grip safety strip is drawn inward by the gripping fingers of a user's hand. The helper spring provides a temporary increase in resistance force felt in the grip safety strip, which then collapses as the spring strip buckles when compressed by contact with the second rotatable lever. The buckled spring strip resets itself when the grip safety strip is released. Also, one of two bosses [74] of this embodiment is shown in cross section to reveal a threaded hole typically used for mounting a Picatinny rail, a tactical flashlight, or other related accessories.

Figure 7B:
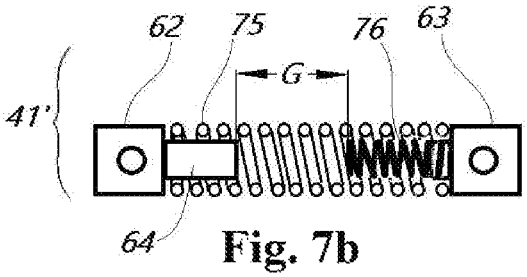
FIG. 7*b* shows some components of the elastic member of FIG. 7*a* with one of the helical springs shown in cross section.

FIG. 7*b* shows some components of the second elastic component [41'] of FIG. 7*a* having a first helical spring [75] shown in cross section. The helical springs reside between the first grip trigger spring anchor [62] and the second grip trigger spring anchor [63.] Within the context of the second elastic component alone, the first grip trigger spring anchor and the second grip trigger spring anchor may be called first and second spring anchors for simplicity. A stop feature [64] on the first spring anchor extends toward the second spring anchor, and a second helical spring [76] resides coaxially within the first spring, attached to the second spring anchor and extending toward the first spring anchor and its stop feature but leaving a gap [G] there between. When motion of the second rotatable lever draws the first and second spring anchors together, the gap closes so that at a predetermined and adjustable point, the spring rate of the second helical spring adds to the first helical spring to create a non-linear ramp-up in resistance force felt by the gripping fingers of the user's hand. The non-linear ramp-up may be tuned to replicate similar non-linearities felt in grip safety systems of various makes and models of handguns. In the actual handguns being modeled by this grip training aid, these non-linearities arise from grip safety components interacting with firing pin cocking mechanisms and fire control components within a trigger group.

Figure 7C:
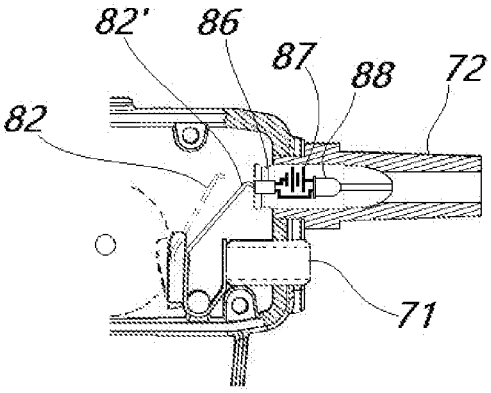
FIG. 7*c* shows optional components located in the muzzle end of an embodiment of a training aid in accordance with the invention.

FIG. 7*c* shows optional components located in the muzzle end of an embodiment of a training aid in accordance with the invention. A replica gun barrel component [72] has a central bore which houses a laser, a collimated light source, a coherent light source, or a light emitting diode (LED) [88] which is connected to a switch [86] and a battery [87.] The switch is closed when sufficient deflection of the stop pawl out of its locked position is mechanically detected. Means for closing the switch may include a wand [82] extending from the trigger lock spring which is displaced when the stop pawl is dislodged from its locked position. According to one alternative embodiment, the trigger lock spring and the wand are conductive elements which comprise an electrical switch delivering current from the battery to the light source. The battery may be located anywhere within the frame, and its location may be determined based on ease of access for replacement, or how its location contributes to the overall center of mass of the grip training aid. According to another alternative embodiment, the electrical switch is a pressure sensitive switch disposed between the trigger lock spring and the adjustment set screw [71] to sense increased compression between these components when the stop pawl is dislodged. Another embodiment within the scope of the invention incorporates a magnet into the stop pawl or includes making the stop pawl itself out of a magnetized or magnetic material, and may have the switch be a Hall effect switch which closes or signals that proximity to the magnetized item has changed, and this signal may be detected by an electronic or electrical circuit which responds by delivering current to the light source while and whenever the proximity condition is satisfied.

Another embodiment within the scope of the invention includes a chamber formed in the replica gun barrel which is shaped to receive a commercially available "laser ammo" product. The laser ammo is a replica handgun cartridge containing a power source, a laser LED, and a switch located where the primer of an ammunition cartridge would be. Inserting a laser ammo device into a firearm and pulling the firearm trigger causes the firing pin of the firearm to strike and close a switch integral to the laser ammo device, which then emits a light beam so that a user can confirm a point of aim and can develop muscle memory for accurate aiming of a weapon as a grip condition rather than relying on visual sighting or having to raise a weapon up to a shooter's line of sight before being able to make an acceptably accurate shot. Shooting a weapon by its feel in the hand rather than by optical sighting is an advantageous skill in timed competitions and in actual gun combat. Light emission from the grip training aid may be detected by gaming console sensors to modify events, progress, scenarios, or scores. In summary of the above embodiments which include a light source, a battery and the light source are connected by a switch which is closed when the grip safety strip is held in its retracted position.

Figure 8A:
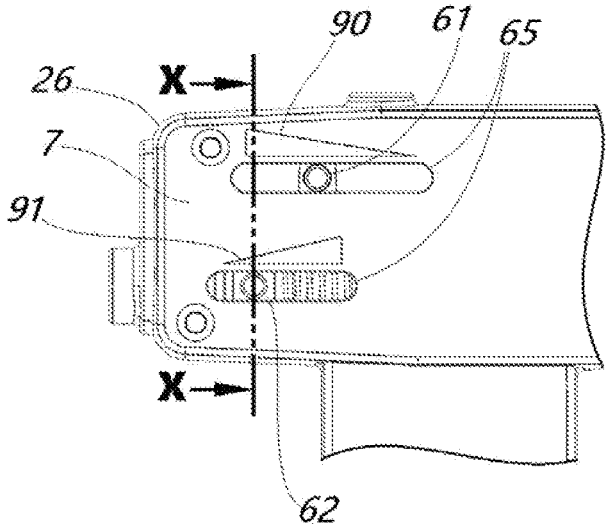
FIG. 8*a* shows a portion of the longitudinal portion of the frame and sidewall with the spring force adjustment indicators, and a section line X-X for the section view of FIG. 8*b*.
Figure 8B:
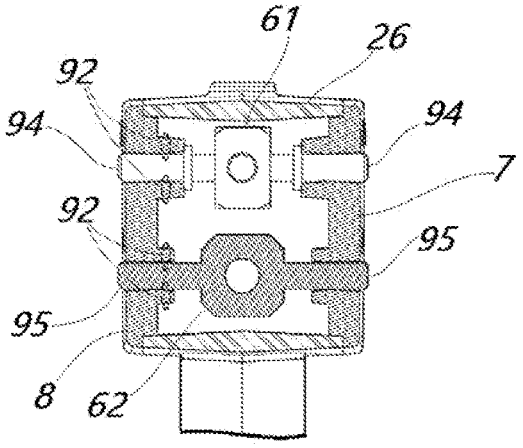
FIG. 8*b* is a cross section view of the components of FIG. 8*a* taken at section line X-X.

FIG. 8*a* shows a portion of the longitudinal portion of the frame [26] and sidewalls [7] having spring force adjustment indicators, and a section line X-X for the section view of FIG. 8*b*. The sidewalls include interiorly extending pairs of rails and the spring anchors include bilaterally extending features which may be rods or tabs which glide between the pairs of rails as the spring anchors are adjusted to control preload forces.

The bilaterally extending features of the spring anchors are visible through slots [65] cut into the sidewalls. Nonverbal indicia proximal to the slots indicate a force range with ramp shapes. Since the first elastic component for trigger pull force operates in tension, an adjustment which moves the trigger spring anchor [61] leftward in this view increases the preload tension and the trigger force felt by the user's trigger finger. Thus, the ramp-shaped indicium [90] increases in thickness from right to left, indicating "force goes up when the rod end visible in this slot moves leftward." Similarly, the second elastic component for grip force operates in compression, and an adjustment which moves the first grip trigger spring anchor [62] rightward increases the preload compression and the gripping force felt by the user's gripping fingers. The ramp-shaped indicium [91] associated to the slot within which the first grip trigger spring anchor is visible increases in thickness from left to right, which indicates "force goes up when the rod end visible in this slot moves rightward."

FIG. 8*b* is a cross section view of the components of FIG. 8*a* taken at section line X-X. The sidewalls [7, 8] fit into the sides of the frame [26] and include interiorly extending pairs of rails [92] and the spring anchors include bilaterally extending features which may be rods or tabs which glide between the pairs of rails as the spring anchors are adjusted to control preload forces. The trigger spring anchor [61] has bilaterally extending rods or tabs [94] which engage and slide along between the rails, and the first grip trigger spring anchor [62] has bilaterally extending rods or tabs [95] which engage and slide along between the rails.

By trapping the rod ends between these pairs of rails, each spring anchor is prevented from parasitically turning while its adjustment set screw or cap screw is turned. It is also contemplated within the scope of the invention that the spring anchors may include transverse holes into which rods or dowels or roll pins may be inserted so that the ends of these are received in between pairs of internal rails extending inwardly from the interior surfaces of the sidewalls.

Figure 9A:
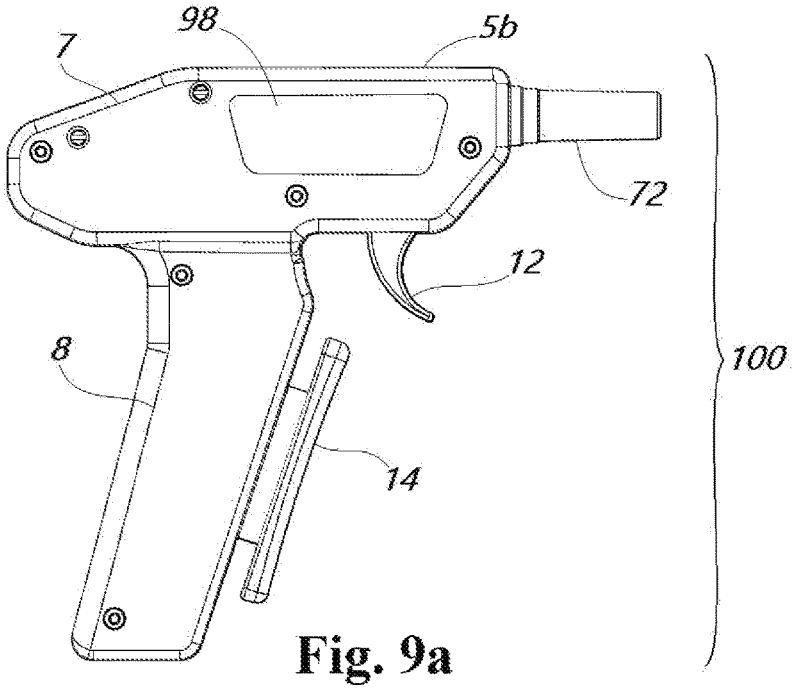
FIG. 9*a* is a view of the right side of an additional embodiment of a grip training aid within the scope of and in accordance with the invention.

FIG. 9*a* shows a side view of another alternative embodiment of a grip training aid [100] in accordance with the invention which view of the right side of the device. This external view shows two substantially planar sidewalls [7] and [8] in place, with the sidewall for the portion of the frame that defines the generally longitudinal volume including a label surface [98] which may be a raised plane or a recessed planar pocket, or if the sidewall is cosmetically textured, the label surface may be an smooth area devoid of such a texture. Indicia such as brand names, logos, or cautionary or instructive texts may be included in this area by relieved or recessed lettering or by one or more stickers affixed in this area. In this embodiment both sidewalls are part of an integral frame half [5*b*,] however, the invention may also be constructed with the sidewalls being separately removable from the frame. This embodiment includes a replica gun barrel component [72,] a first rotatable lever [12] which is fashioned to resemble a trigger, and a grip safety strip [14.]

Figure 9B:
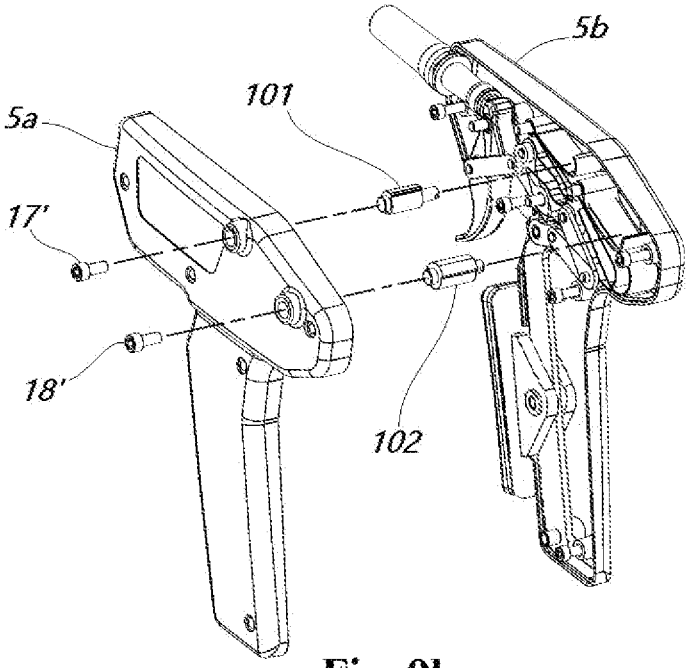
FIG. 9*b* shows the embodiment of FIG. 9*a* with the left half-frame split apart to expose internal components of the invention.

FIG. 9*b* shows the embodiment of FIG. 9*a* with the left half-frame [5*a*] split apart from the right half-frame [5*b*] to expose internal components of the invention. The operation and "feel" of the elastic members in this embodiment are adjusted by angular orientations of two reinforcer cams. One end of each reinforcer cam includes a slotted end for receiving a screwdriver blade or similar adjusting tool, and the other end is secured by a screw or set screw to prevent rotation once it is adjusted as desired. The first reinforcer cam [101] is a trigger reinforcer cam, and the second reinforcer cam [102] is a grip trigger reinforcer cam. Adjustment cap screw [17'] locks the trigger reinforcer cam and adjustment cap screw [18'] locks the grip trigger reinforcer cam.

Figure 9C:
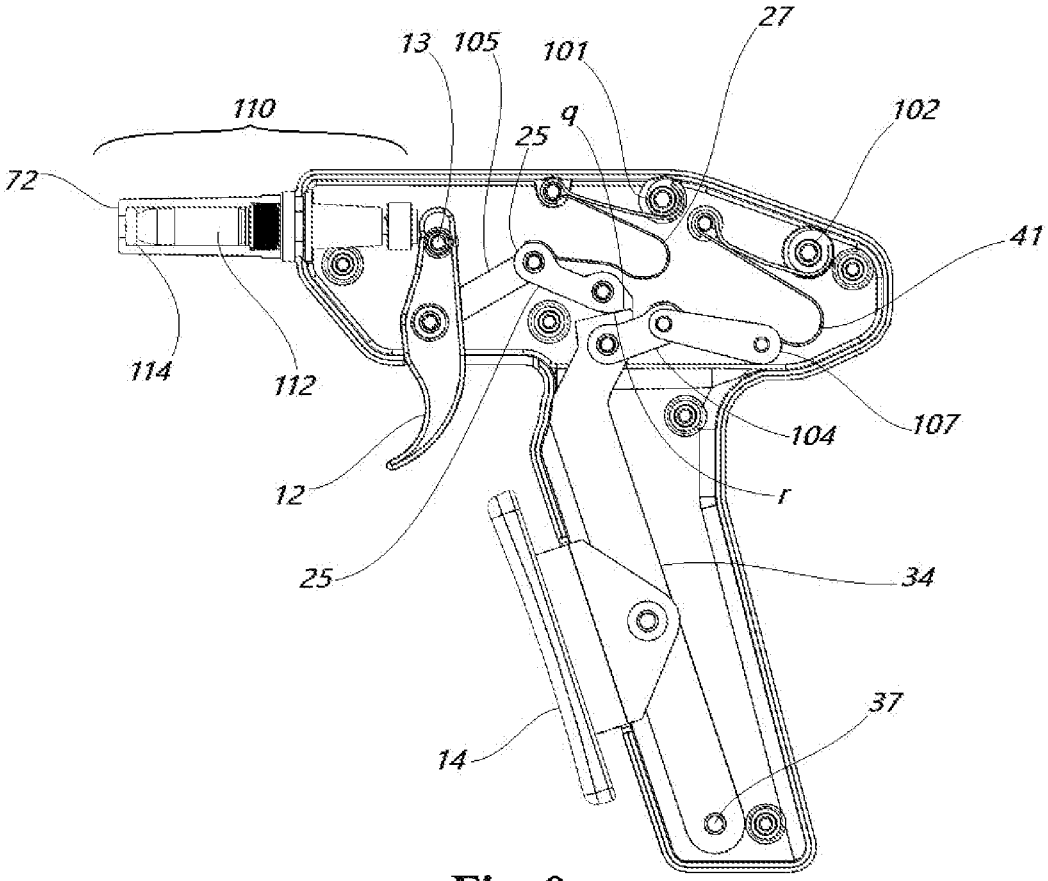
FIG. 9*c* shows the embodiment of FIG. 9*a* with its first and second rotatable levers relaxed in their extended positions.

FIG. 9*c* shows the embodiment of FIG. 9*a* with its first and second rotatable levers relaxed in their extended positions. Components of the laser sight subassembly [110] are shown and described in detail in FIG. 11. The replica gun barrel [72] houses a commercially available "laser ammo" product as described previously. The bullet nose of the cartridge shape of the laser ammo [112] is elastically secured in an elastomeric torus such as an o-ring [114.] The trigger mechanism comprises a first rotatable lever [12] which simulates a trigger, a first toggle [105,] a second toggle which acts as a stop pawl [25,] a first elastic member [27,] and a first helper spring for the first elastic member. The preload, contour, and the point of contact which arises between the first elastic member and the first helper spring may be adjusted by means of a trigger reinforcer cam [101.] The first rotatable lever pivots about a pivot point which is a screw, pin, or dowel at [13.] The trigger lever attaches to a first end of the first trigger mechanism toggle, and the second end of the first trigger mechanism toggle attaches to a first end of the second trigger mechanism toggle. The second end of the second trigger mechanism toggle includes a nose which acts as a stop pawl.

The grip trigger mechanism comprises a second rotatable lever [34,] a grip trigger first toggle [104,] a grip trigger second toggle [107,] a second elastic member [41,] and a second helper spring for the second elastic member. The preload, contour, and the point of contact which arises between the second elastic member and the second helper spring may be adjusted by means of a trigger reinforcer cam [102.] The first rotatable lever pivots about a pivot point at its first end, which is a screw, pin, or dowel at [37.] The second rotatable lever, which is a grip trigger lever attaches to a first end of the first grip trigger mechanism toggle, and the second end of the first grip trigger mechanism toggle attaches to a first end of the second grip trigger mechanism toggle.

A surface [q] of the stop pawl contacts or resides close by a surface [r] of the second end of the grip trigger lever. The surface [q] is part of a protruding nose of the stop pawl so that the second toggle of the trigger mechanism which includes this stop pawl is blocked from rotating as long as the second rotatable lever remains in its extended position as shown in this figure. Thus the trigger of the training aid cannot be pulled unless the grip trigger is retracted by a gripping force of the user's hand overcoming the forces and preload forces residing within the second elastic member and the second helper spring.

Figure 9D:
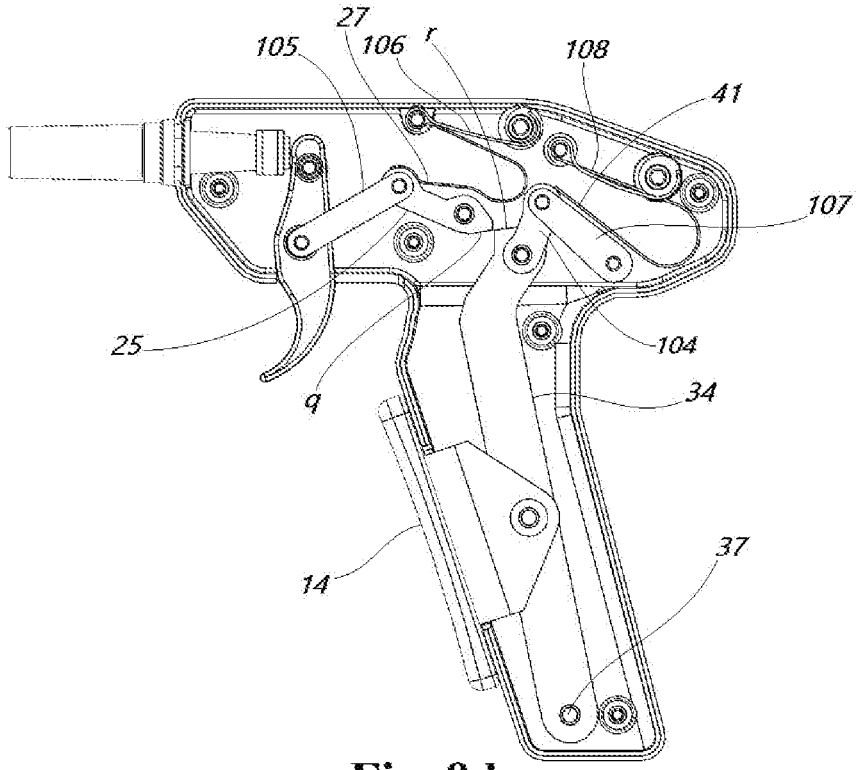
FIG. 9*d* shows the embodiment of FIG. 9*a* with the first rotatable lever extended and the second rotatable lever retracted.

FIG. 9*d* shows the embodiment of FIG. 9*a* with the first rotatable lever extended and the second rotatable lever [34] retracted by pivoting on the screw, pin, or dowel [37] at the lower portion of the grip. The first toggle [105] of the trigger mechanism attaches to the first rotatable lever [12] at its first end. The second end of the first trigger mechanism toggle attaches to a first end of the second trigger mechanism toggle [25.] The second end of the second trigger mechanism toggle pivots about a fixed point located by a screw, pin, or dowel. The first elastic member [27] in this embodiment is a strip or leaf spring having an arcuate portion for flexion and compression. A palm or cup-shaped end maintains contact at the pin joint between the first and second trigger toggles during its excursion between an extended and a retracted position. Depending on the adjusted position of the trigger reinforcer cam, the first elastic member may be supported by a first helper spring strip throughout some or all of its deflection during excursion of the trigger between its extended and a retracted positions.

The retracted position of the grip trigger safety strip [14] has rotated the grip trigger mechanism by pivoting the second rotatable lever [34] about a screw, pin, or dowel at [37,] and this in turn pushes and pivots the first toggle [104] of the grip trigger mechanism. The first toggle of the grip trigger mechanism attaches to the second rotatable lever at its first end. The second end of the first grip trigger mechanism toggle attaches to a first end of the second grip trigger mechanism toggle [107.] The second end of the second grip trigger mechanism toggle pivots about a fixed point located by a screw, pin, or dowel. The pinned junction connecting the first and second grip trigger toggles compresses and relaxes the second elastic member [41] during its excursion between an extended and a retracted position of the grip safety strip. Depending on the adjusted position of the grip trigger reinforcer cam, the second elastic member may be supported by a second helper spring strip [108] throughout some or all of its deflection during excursion of the trigger between its extended and retracted positions.

The second helper spring strip provides additional resistance for the thumb, palm, and last three fingers while wrapped around the grip and compressing the grip safety strip. Surface [q] is then freed from surface [r] which allows the first rotatable lever [12] which is the trigger to be actuated by the index finger. If insufficient force is applied to the grip so as to insufficiently retract the grip safety strip, then insufficient travel of the grip safety strip will obtain that surfaces [r] and [q] will not clear one another, and the trigger will not be able to be actuated in accordance with the invention.

Figure 9E:
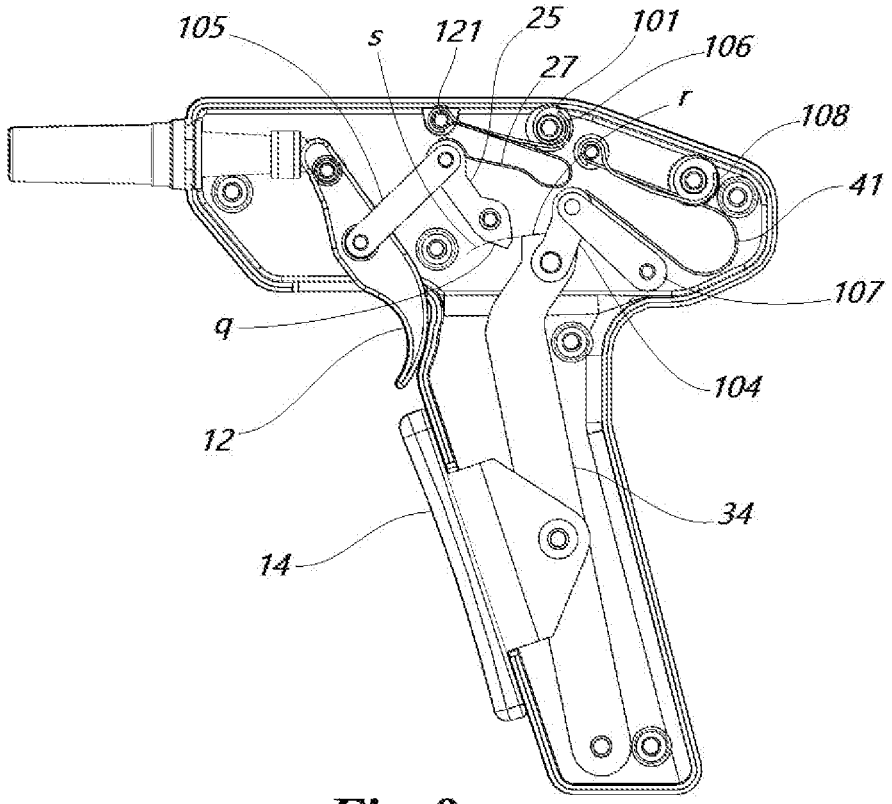
FIG. 9*e* shows the embodiment of FIG. 9*a* with its first and second rotatable levers in their retracted positions.

FIG. 9*e* shows the embodiment of FIG. 9*a* with its first rotatable lever [12] or trigger, and second rotatable lever [34] in their retracted positions. The retracted position of the grip safety strip forces the first toggle [104] of the grip safety to rotate, which in turn pushes the second toggle [107] of the grip safety to compress the second elastic member [41,] aided by the helper spring strip [108] which provides additional resistance for the thumb, palm, and last three fingers compressing the grip safety strip [14.] The second elastic member is in contact with the second helper spring [108.] Surface [q] is then freed from surface [r] which allows the first rotatable lever or trigger to be actuated by the index finger. Resistance to actuation of the trigger is transmitted from the first extendable elastic component [27] as supported by the first helper spring strip. The resistance force travels initially through the first toggle [105] and then to the trigger where it may be felt by the user. The retracted position of the second trigger toggle [25] and its stop pawl are such that in this embodiment this component does not carry a substantial portion of resistance force coming from the first elastic member.

As the trigger is pulled, the contact point between the first elastic member and its helper spring translates laterally between the anchoring pin or dowel [121] and the first reinforcer cam [101.] As the length of the lever arm from the reinforcer cam to the contact point between the two spring strip members shifts, the reaction force of the helper spring as felt at the trigger through the first elastic member drops, because the lever arm is shortening as the trigger pull progresses. The decrease in reaction force from the helper spring when added to the Hooke's law linear increase in reaction force of the first elastic member complement each other to produce a substantially constant force response throughout the excursion of the trigger between its extended and retracted positions. The interaction of the second elastic member and its helper spring may also be similarly designed to linearize the reaction force felt in the grip trigger mechanism throughout its excursion between its extended and retracted positions, or to stabilize the reaction force at or near a constant value throughout this excursion.

FIG. 9*e* also shows a portion of the boundary [s] of a swept volume subtended by the motion of the second rotatable lever between its extended and retracted positions. The second trigger toggle has a nose which is a stop pawl and which traverses a volume occupied by the second rotatable lever when not in its retracted position. The first rotatable lever or trigger is blocked from moving into its retracted position while the second rotatable lever or grip trigger is not in its retracted position, because the stop pawl cannot move into the space occupied by the grip trigger.

Figure 10A:
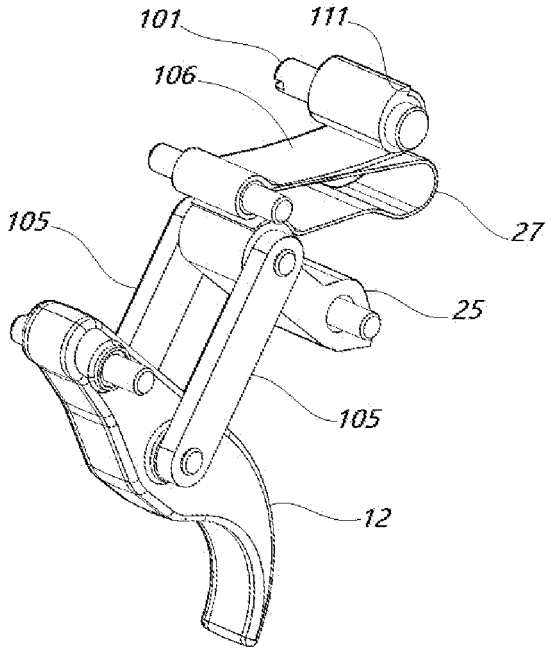
FIG. 10*a* shows the first rotatable lever, toggles, and elastic members which comprise a trigger linkage assembly in accordance with the invention.

FIG. 10*a* shows the first rotatable lever [12,] first trigger toggles [105,] a first extendable elastic component [27,] a first helper spring strip [106,] and a first reinforcer cam [101] which comprise a trigger linkage assembly in accordance with the invention. The radially oriented step surface [111] of the reinforcer cam catches a curl at the end of the helper spring strip so that its radial orientation adjusts a belly formed in the helper spring and its contact behaviour with respect to the first elastic member.

Once the second rotatable lever is clear of the stop pawl, the first rotatable lever may be actuated in accordance with the invention. The actuation of the trigger forces the first trigger toggles upward to pivot the stop pawl [25.] The trigger toggles receive resistance force from the first extendable elastic component and the first helper spring.

Figure 10B:
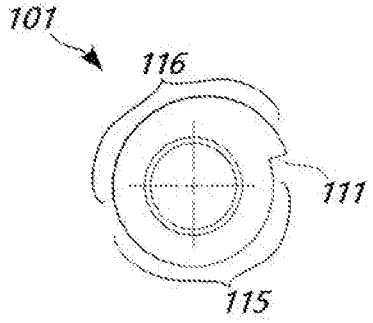
FIG. 10*b* shows an end view of a trigger reinforcer cam in accordance with the invention.

FIG. 10*b* shows an end view of a first reinforcer cam [101] in accordance with the invention, which is a trigger reinforcer cam. The contour of this cam includes a circular portion [115] tangent to an adjacent elliptical portion [116,] and a radially oriented step surface [111.] The second reinforcer cam is fashioned with similar contours and has a similar radially oriented step surface.

Figure 10C:
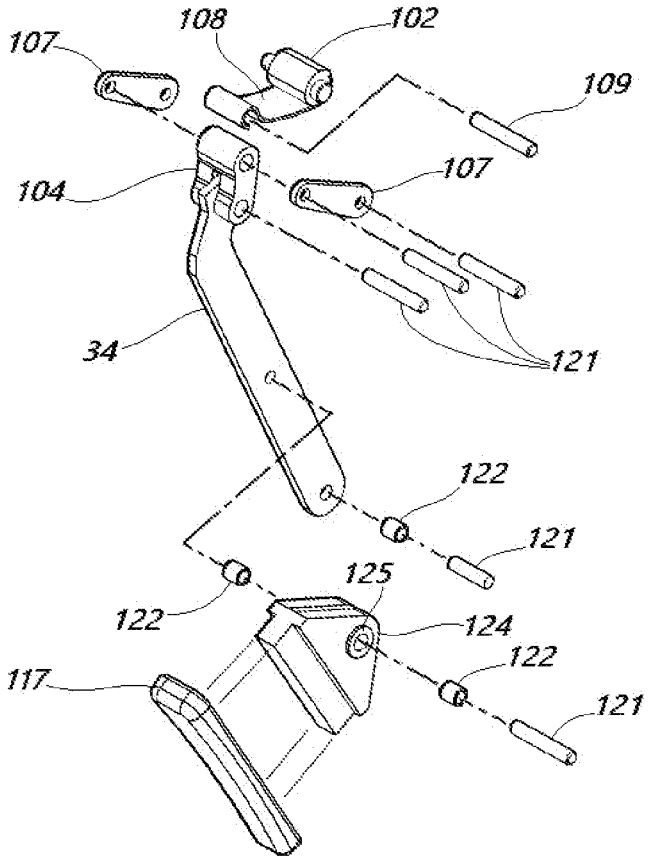
FIG. 10*c* shows the second rotatable lever, a grip trigger pad and its pad support, toggles, pins, bushings, and an elastic member which is a helper spring, which comprise a grip trigger linkage assembly in accordance with the invention.

FIG. 10*c* shows the second rotatable lever, a grip trigger pad and its pad support, toggles, pins, bushings, and an elastic member which is a second helper spring, which comprise a grip trigger linkage assembly in accordance with the invention. The grip safety strip [14 in FIG. 9*a*] comprises here a grip trigger pad [117] and a grip trigger pad support [124] which includes a clevis portion of two parallel vanes into which the second rotatable lever [34] fits. The vanes each include an outward-facing boss [125] which receives a bushing [122] and the bushings ride on a pivot pin [121] which is fixed into the frame or a frame-half of the grip training aid. The grip trigger pad and its support are able to pivot so as to collect grip force from the user and apply it to pivoting the second rotatable lever.

A first end of the second rotatable lever rides on a bushing and pivots about a point anchored by another pivot pin. A second end opposite the first end is pinned to a first of two toggles [107.] The second elastic member [41 on FIG. 9*e*] is omitted in this view, but when the second rotatable lever pivots toward its retracted position, the first toggle [104] of the grip trigger mechanism then pivots so that its connection point to the second toggle compresses the second elastic member. Although a workable linkage may comprise only a single instance of either the first and second of these toggles or only one of each of them, in this embodiment shown two second toggles bestride a single first toggle.

The second elastic member in this embodiment is a formed strip of springy material such as spring steel strip or phosphor bronze, or a stainless steel, any of which may be mill hardened to produce appropriate and enduring material properties. Equivalent mechanical behaviours may be obtained by fashioning these and other elastic members of the invention out of music wire. Other compressible members and helper springs of this invention in this and other embodiments may be similarly constructed. When compressed, a portion of the spring strip impinges upon a helper spring strip [108] which is a trigger reinforcer spring. The helper spring strip is pinned at a first end by a pin [109] which is retained by the frame, or retained by one or both frame-halves. The second end of the helper spring strip is curled to be complementary to the circular contour portion of the grip trigger reinforcer cam [102] which is the second reinforcer cam of the invention. The location of the end of the curl of the trigger reinforcer spring may be adjusted radially, which adjusts the bending preload and the contour of the bend in this helper spring. According to an alternative embodiment of the invention, when the user squeezes the grip trigger, a gap between the second elastic member strip spring and this helper strip string closes and the user experiences a two-tiered resistance. Alternatively, the grip trigger reinforcer cam may be adjusted so that the helper spring remains in contact with the second elastic member strip spring throughout the entire range of motion of the grip trigger mechanism, including its fully extended position.

Although the springs are shown here as strip materials, it is also within the scope of the invention that the elastic members and helper springs comprise helical springs or spiral springs, operating in compression or in tension. Furthermore, especially as seen in FIGS. 9*c*, 9*d*, 9*e*, and 10*a*, where an elastic member is made as a formed strip of springy material the width of the spring strip may vary along its length to provide resistance forces which are more constant over an excursion between an extended and a retracted position, and an elastic member may also be formed as a material strip including an arcuate portion with a straight portion extending from either or both ends of such an arcuate portion. A helper spring in accordance with the invention may be formed as a straight or arcuate strip spring simply supported at both its ends, with such a strip having one curled end in contact with the radially oriented surface of a cam reinforcer so that an adjustable angular position of the cam reinforcer creates a camber or belly in the helper spring strip for controlling the distance from the cam reinforcer of a point of contact between the helper spring and the elastic member which it supports.

Figure 11:
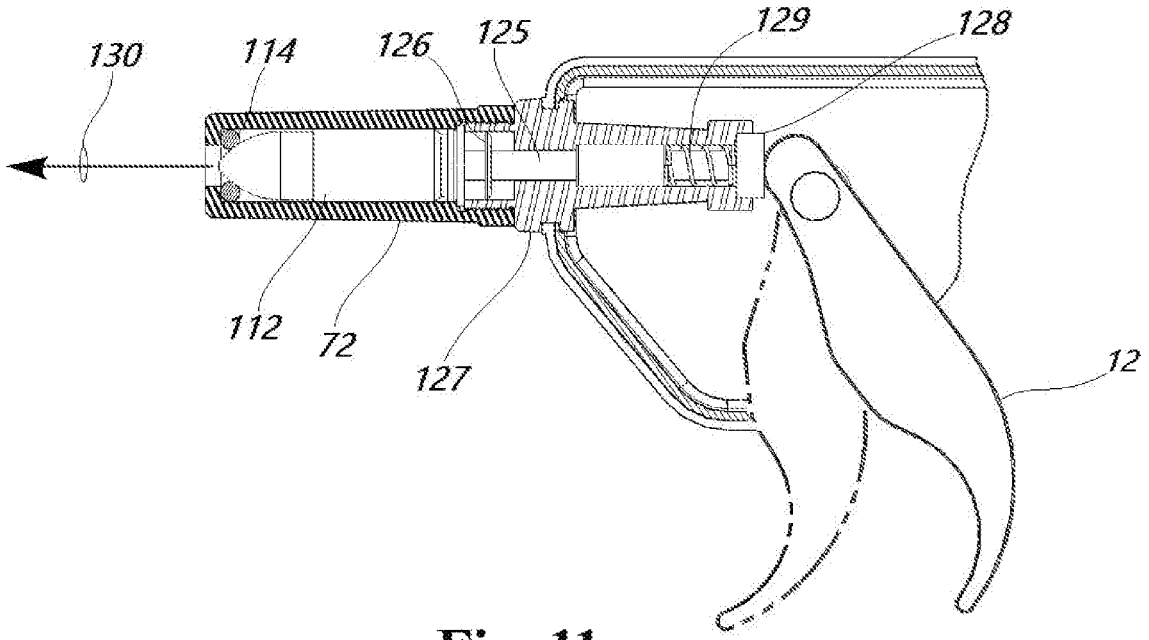
FIG. 11 shows a cross section of a laser sight sub assembly in accordance with the invention.

FIG. 11 shows a cross section of a laser sight subassembly previously identified as [110] in FIG. 9*c* in accordance with the invention. When the grip trigger is retracted properly then the first retractable lever [12] may be actuated. The end of the trigger inside the housing has a rounded protrusion which, when the trigger is pulled, pushes on the plunger pad [128.] An additional weakly compressible shim (not shown) may reside between the trigger and the plunger to take up assembly tolerance such as over-travel of the impinging head of the trigger lever without contributing axial actuation force within the plunger. The plunger is contained within the laser sight mounting block [127] and has a push nut [126] attached on the end which in turn impinges on a switch of the laser ammo [112] product. A plunger compression spring [129] retracts the plunger away from the laser ammo switch while the trigger is not pulled. When pulled, the trigger mechanism illuminates a laser light beam that [130] is directed out the end of, and substantially in line with, the replica gun barrel component [72] so that a user can confirm a point of aim and can develop muscle memory for accurate aiming of a weapon as a grip condition rather than relying on visual sighting or having to raise a weapon up to a shooter's line of sight before being able to make an acceptably accurate shot. Shooting a weapon by its feel in the hand rather than by optical sighting is an advantageous skill in timed competitions and in actual gun combat. Light emission from the grip training aid may be detected by gaming console sensors to modify events, progress, scenarios, or scores. The laser ammo is elastically secured, or cushioned, within the interior end of the replica gun barrel component by an elastomeric torus such as an o-ring [114.]

While certain features and aspects have been described with respect to exemplary embodiments, one skilled in the art will recognize that numerous modifications are possible. Further, while various methods and processes described herein may be described with respect to particular structural and/or functional components for ease of description, methods provided by various embodiments are not limited to any particular structural and/or functional architecture.

Hence, while various embodiments are described with or without certain features for ease of description and to illustrate exemplary aspects of those embodiments, the various components and/or features described herein with respect to a particular embodiment may be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A grip training aid, comprising:

a frame, further comprising a grip site for a human hand, a first rotatable lever, a first elastic component connected between said frame and said first rotatable lever, a second rotatable lever, a second elastic component connected between said frame and said second rotatable lever, said rotatable levers positioned such that with said hand gripping said frame at said grip site, said first rotatable lever is prehensible by an index finger of said hand, and said second rotatable lever is prehensible by at least one finger of said hand selected from the set of fingers consisting of: a second finger, a third finger and a fourth finger, and wherein a connection site of said second elastic component to said second rotatable lever is adjustable.

2. The grip training aid of claim 1, wherein said frame comprises a tube.

3. The grip training aid of claim 1, wherein both said first and second elastic components are deposited within said frame.

4. The grip training aid of claim 1, wherein a connection site of said first elastic component to said first rotatable lever is adjustable.

5. The grip training aid of claim 1, further comprising a battery, a light source, and a switch which is closed when said second rotatable lever is in a retracted position.

6. A grip training aid, comprising:

a frame, further comprising a first portion having a first membrane defining a generally longitudinal volume and defining a longitudinal axis and a second grip body portion attached to said first portion with said grip body portion also comprising a second membrane with a portion of said second membrane defining a grip site and a grip body axis within 35° of perpendicular to said longitudinal axis of said first portion, a first rotatable lever, a first elastic component connected between said frame and said first rotatable lever, a second rotatable lever, a second elastic component connected between said frame and said second rotatable lever, a third rotatable lever, a grip safety strip further comprising at least two contact pads, said grip safety strip slideable between an extended position and a retracted position in said second grip body portion of said frame, said grip safety strip attached to said third rotatable lever, a rocker plate further comprising contact pads complementary to said at least two contact pads of said grip safety strip, said rocker plate pivotably attached to said second rotatable lever, so that said rocker plate may rotate to align its complementary contact pads to said contact pads of said grip safety strip, and with said rotatable levers positioned such that with said hand gripping said frame at said grip site, said first rotatable lever is prehensible by an index finger of said hand, and said second rotatable lever is prehensible by at least one finger of said hand selected from the set of fingers consisting of: a second finger, a third finger and a fourth finger.

7. The grip training aid of claim 6, wherein said first and second elastic components each further comprise at least one helical spring.

8. The grip training aid of claim 6, further comprising a helper spring which buckles when compressed by contact with said second rotatable lever.

9. The grip training aid of claim 6, wherein said first rotatable lever is a trigger having a trigger pivot point, and said grip training aid further comprising at least one trigger travel anchor pivotable about said trigger pivot point, and comprising a cutout which receives a stop pawl so as to prevent rotation of said trigger travel anchor while said grip safety strip not in its retracted position, and a trigger cam lever having an arcuate edge and operably coupled to said second rotatable lever, so that with said grip safety strip in its retracted position, said arcuate edge dislodges said stop pawl from said trigger travel anchor cutout to allow rotation of said trigger travel anchor.

10. The grip training aid of claim 9, wherein said trigger is disposed between two trigger travel anchors coupled for coaxial rotation therewith.

11. The grip training aid of claim 10, wherein said trigger further comprises an aperture, and said trigger travel anchors are attached for coupled rotation by a fastener passing through said aperture.

12. The grip training aid of claim 9, wherein said trigger cam lever further comprises a slot, and said rotatable lever further comprises a pin received within said slot.

13. The grip training aid of claim 6, wherein said second elastic component further comprises a first helical spring extending between a first spring anchor and a second spring anchor, and a second helical spring attached to said second spring anchor.

14. The grip training aid of claim 13, wherein said first spring anchor further comprises a stop feature, with a gap between said stop feature and said second helical spring.

15. The grip training aid of claim 6, further comprising a side plate attached to said frame, with said side plate further comprising a ramp-shaped indicium.

16. The grip training aid of claim 6, further comprising a battery, a light source, and a switch which is closed when said grip safety strip is in said retracted position.

17. A grip training aid, comprising:

a frame, further comprising a grip site for a human hand, a first rotatable lever which is a trigger, a first trigger toggle and a second trigger toggle coupled to said first trigger toggle, a first elastic member connected between said frame and said first trigger toggle, a second rotatable lever which is a grip trigger, first and second grip trigger toggles, a second elastic member connected between said frame and said first grip trigger toggle, said first and second rotatable levers each having extended and retracted positions, and with said second trigger toggle further comprising a stop pawl which traverses a volume occupied by said second rotatable lever when not in its retracted position, such that said first rotatable lever is blocked from moving into its retracted position while said second rotatable lever is not in its retracted position.

18. The grip training aid of claim 17, further comprising a first helper spring in contact with said first elastic member and a second helper spring in contact with said second elastic member.

19. The grip training aid of claim 17, further comprising a cam reinforcer having a contour comprising a circular portion, an elliptical portion, and a radially oriented step surface.

20. The grip training aid of claim 17, further comprising a battery, a light source, and a switch which is closed when said second rotatable lever is in said retracted position.

21. The grip training aid of claim 17, wherein said first and second elastic members each further comprise at least one helical spring.

22. The grip training aid of claim 17, wherein a connection site of said first elastic member to said first rotatable lever is adjustable.

23. The grip training aid of claim 17, wherein a connection site of said second elastic member to said second rotatable lever is adjustable.

* * * * *